US011224784B2

(12) United States Patent
Jertson et al.

(10) Patent No.: US 11,224,784 B2
(45) **Date of Patent: *Jan. 18, 2022**

(54) CLUB HEADS WITH VARYING GROOVE PARAMETERS AND RELATED METHODS

(71) Applicant: KARSTEN MANUFACTURING CORPORATION, Phoenix, AZ (US)

(72) Inventors: Martin Jertson, Phoenix, AZ (US); Ryan Stokke, Anthem, AZ (US); Evan Greer, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/696,805

(22) Filed: Nov. 26, 2019

(65) Prior Publication Data

US 2020/0094115 A1 Mar. 26, 2020

Related U.S. Application Data

(63) Continuation of application No. 15/803,530, filed on Nov. 3, 2017, now abandoned, which is a (Continued)

(51) Int. Cl.
*A63B 53/00* (2015.01)
*A63B 53/04* (2015.01)

(52) U.S. Cl.
CPC ..... *A63B 53/04* (2013.01); *A63B 53/047* (2013.01); *A63B 53/005* (2020.08); *A63B 53/0408* (2020.08); *A63B 53/0445* (2020.08)

(58) Field of Classification Search
CPC ..... A63B 53/04; A63B 53/047; A63B 2053/0445; A63B 2053/005
(Continued)

(56) References Cited

U.S. PATENT DOCUMENTS 4,753,440 A 6/1988 Chorne
4,988,104 A 1/1991 Shiotani et al.
(Continued)

FOREIGN PATENT DOCUMENTS

JP 61-91254 U 6/1986
JP H05317463 A 12/1993
(Continued)

OTHER PUBLICATIONS

International Search Report from corresponding PCT Application No. PCT/US2012/057503, dated Feb. 27, 2013.
(Continued)

*Primary Examiner* — John E Simms, Jr.

(57) ABSTRACT

Some embodiments include a first golf club head and a second golf club head. The first golf club head includes a body having a face portion, and the second golf club head includes a body having a face portion. Meanwhile, the first club face portion comprises a face surface and at least one first club groove, and the second club face portion comprises a face surface and at least one second club groove. An edge radius of the first club head groove(s) can be less than an edge radius of the second club head groove(s), a base width of the first club head groove(s) can be less than a base width of the second club head groove(s), and/or a sidewall angle of the first club head groove(s) can be greater than a sidewall angle of the second club head groove(s). Other embodiments of related club heads and methods are also disclosed.

20 Claims, 7 Drawing Sheets

Related U.S. Application Data continuation of application No. 15/295,421, filed on Oct. 17, 2016, now Pat. No. 9,855,472, which is a continuation of application No. 14/833,497, filed on Aug. 24, 2015, now Pat. No. 9,555,297.

(60) Provisional application No. 62/042,164, filed on Aug. 26, 2014.

(58) Field of Classification Search
USPC ..... 473/287, 290
See application file for complete search history.

(56) References Cited

U.S. PATENT DOCUMENTS

| | | | | |
|---|---|---|---|---|
| 5,090,702 | A | 2/1992 | Viste | |
| 5,417,419 | A | 5/1995 | Anderson | |
| 5,472,201 | A | 12/1995 | Aizawa et al. | |
| 5,591,092 | A * | 1/1997 | Gilbert | A63B 53/04 473/330 |
| 5,618,239 | A | 4/1997 | Rife | |
| 5,643,099 | A | 7/1997 | Solheim | |
| 5,688,186 | A | 11/1997 | Michaels et al. | |
| 5,709,616 | A | 1/1998 | Rife | |
| 5,709,617 | A | 1/1998 | Nishimura et al. | |
| 5,766,087 | A * | 6/1998 | Kawamatsu | A63B 53/04 473/290 |
| 5,967,903 | A | 10/1999 | Cheng | |
| 6,322,459 | B1 | 11/2001 | Nishimura et al. | |
| 7,261,644 | B2 | 8/2007 | Burrows | |
| 7,780,548 | B2 | 8/2010 | Solheim | |
| D624,616 | S | 9/2010 | Rife | |
| D624,617 | S | 9/2010 | Rife | |
| 7,905,797 | B2 | 3/2011 | Gilbert et al. | |
| 7,927,230 | B2 | 4/2011 | Solheim | |
| 8,066,586 | B2 | 11/2011 | Solheim et al. | |
| 8,282,505 | B2 | 10/2012 | Solheim | |
| 8,328,662 | B2 | 12/2012 | Nakamura | |
| 8,409,029 | B2 | 4/2013 | Abe | |
| 8,523,703 | B2 | 9/2013 | Rife | |
| 8,545,343 | B2 | 10/2013 | Boyd | |
| 8,764,578 | B2 | 7/2014 | Solheim | |
| 8,790,193 | B2 | 7/2014 | Serrano | |
| 8,814,720 | B2 | 8/2014 | Solheim | |
| 8,827,832 | B2 | 9/2014 | Breier | |
| 9,370,699 | B1 * | 6/2016 | Ines | A63B 53/047 |
| 9,555,297 | B2 * | 1/2017 | Jertson | A63B 53/04 |
| 9,855,472 | B2 * | 1/2018 | Jertson | A63B 53/04 |
| 2004/0214654 | A1 * | 10/2004 | Pelz | A63B 53/04 473/287 |
| 2005/0209020 | A1 | 9/2005 | Burrows | |
| 2007/0010346 | A1 | 1/2007 | Gilbert | |
| 2009/0143166 | A1 * | 6/2009 | Ban | A63B 53/047 473/331 |
| 2009/0209361 | A1 * | 8/2009 | Solheim | A63B 53/047 473/331 |
| 2009/0325728 | A1 | 12/2009 | Solheim | |
| 2010/0035702 | A1 | 2/2010 | Solheim et al. | |
| 2010/0113180 | A1 * | 5/2010 | Nakamura | A63B 53/047 473/331 |
| 2010/0304884 | A1 * | 12/2010 | Nakamura | A63B 53/04 473/330 |
| 2010/0311518 | A1 | 12/2010 | Kumamoto | |
| 2010/0317458 | A1 | 12/2010 | Abe | |
| 2011/0098129 | A1 * | 4/2011 | Sugimoto | A63B 53/047 473/331 |
| 2011/0105240 | A1 * | 5/2011 | Abe | A63B 53/047 473/291 |
| 2011/0165963 | A1 | 7/2011 | Cackett | |
| 2011/0300967 | A1 | 12/2011 | Ban | |
| 2012/0135819 | A1 | 5/2012 | Uetz | |
| 2012/0264537 | A1 | 10/2012 | Breier | |
| 2013/0157776 | A1 | 6/2013 | Serrano et al. | |
| 2013/0260912 | A1 | 10/2013 | Jertson | |
| 2014/0228143 | A1 | 8/2014 | Roach | |
| 2014/0274451 | A1 | 9/2014 | Knight | |

FOREIGN PATENT DOCUMENTS

| | | |
|---|---|---|
| JP | H1015116 A | 6/1996 |
| JP | 2007007181 | 1/2007 |

OTHER PUBLICATIONS

Written Opinion from corresponding PCT Application No. PCT/US2012/057503, dated Feb. 27, 2013.
International Search Report for Application No. PCT/US2015/018813 dated Jun. 5, 2015 (7 pages).
International Written Opinion for Application No. PCT/US2015/018813 dated Jun. 5, 2015 (4 pages).

* cited by examiner

CLUB HEADS WITH VARYING GROOVE PARAMETERS AND RELATED METHODS

CROSS-REFERENCE TO RELATED APPLICATIONS

This is a continuation of U.S. patent application Ser. No. 15/803,530, filed Nov. 3, 2017, which is a continuation of U.S. patent application Ser. No. 15/295,421, filed Oct. 17, 2016, now U.S. Pat. No. 9,855,472, issued on Jan. 2, 2018, which is a continuation of U.S. Non-Provisional patent application Ser. No. 14/833,497, filed Aug. 24, 2015, now U.S. Pat. No. 9,555,297, issued on Jan. 31, 2017, which claims the benefit of U.S. Provisional Patent Application No. 62/042,164, filed on Aug. 26, 2014, the entire contents of which are fully incorporated herein.

TECHNICAL FIELD

This disclosure relates generally to sports equipment, and relates more particularly to golf club heads and related methods.

BACKGROUND

In certain circumstances, it may be desirable to impart a spin on a golf ball hit with a golf club. For example, as the distance the golf ball is intended to travel decreases, it may be desirable to impart an increasing amount of spin on the golf ball. This may be particularly true when chipping (e.g., hitting golf balls over distances less than or equal to about 35 to 40 meters). Generally, golf clubs with higher loft angles (e.g., loft angles greater than or equal to 45 degrees and less than or equal to 65 degrees) are implemented to hit shots of shorter lengths.

BRIEF DESCRIPTION OF THE DRAWINGS

To facilitate further description of the embodiments, the following drawings are provided in which.

Figure 1:
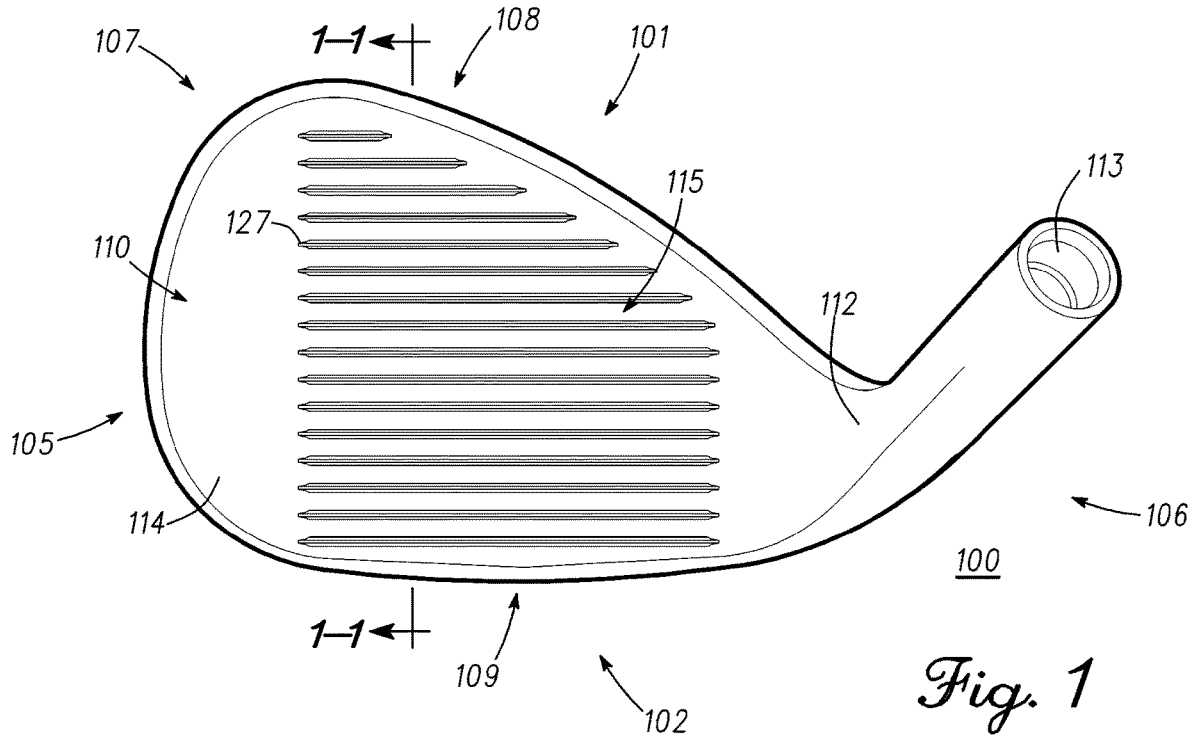
FIG. 1 illustrates a front view of a club head, according to an embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi-permanent or only for an instant.

"Mechanical coupling" and the like should be broadly understood and include mechanical coupling of all types.

The absence of the word "removably," "removable," and the like near the word "coupled," and the like does not mean that the coupling, etc. in question is or is not removable.

DESCRIPTION

Some embodiments include a set of golf club heads. The set comprises a first golf club head comprising: (i) a first top end and a first bottom end opposite the first top end; (ii) a first front end and a first rear end opposite the first front end; (iii) a first toe end and a first heel end opposite the first toe end; (iv) a first club head body comprising a first club face portion; (v) a first club shaft axis comprising a first club top-to-bottom axis extending between the first top end and the first bottom end, a first club front-to-rear axis extending between the first front end and first rear end, and a first club heel-to-toe axis extending between the first heel end and the first toe end; and (vi) a first club address configuration. Also, the set comprises a second golf club head comprising: (i) a second top end and a second bottom end opposite the second top end; (ii) a second front end and a second rear end opposite the second front end; (iii) a second toe end and a second heel end opposite the second toe end; (iv) a second club head body comprising a second club face portion; (v) a second club shaft axis comprising a second club top-to-bottom axis extending between the second top end and the second bottom end, a second club front-to-rear axis extending between the second front end and second rear end, and a second club heel-to-toe axis extending between the second heel end and the second toe end; and (vi) a second club address configuration.

Meanwhile, the first club face portion can comprise a first club face surface and at least one first club groove, and the first club face portion can be located at the first front end. The first club top-to-bottom axis, the first club front-to-rear axis, and the first club heel-to-toe axis can be approximately perpendicular to each other. Further, when the first golf club head is positioned in the first club address configuration, the first club top-to-bottom axis can be approximately perpendicular to a first ground plane, and/or the first golf club head can comprise a first club loft angle greater than or equal to approximately 55 degrees. Further still, each first club groove, respectively, of the at least one first club groove comprises a first club groove base, a first club groove sidewall adjacent to the first club groove base, a first club groove edge point, a first club groove edge radius at the first club groove edge point, and a first club groove central axis approximately perpendicular to the first club groove base. Even further still, the at least one first club groove can be symmetric across the first club groove central axis in a first club cross plane, and the first club cross plane can be approximately parallel to a first club cross plane formed by the first club top-to-bottom axis and the first club front-to-rear axis. Also, the first club edge point can satisfy a Thirty Degree Rule, the first club groove base can comprise a first groove base width approximately parallel to the first club face surface and extending approximately perpendicular to the first club heel-to-toe axis, and the first club groove sidewall can form a first club groove sidewall angle with the first club groove central axis.

Meanwhile, the second club face portion can comprise a second club face surface and at least one second club groove, and the second club face portion can be located at the second front end. The second club top-to-bottom axis, the second club front-to-rear axis, and the second club heel-to-toe axis can be approximately perpendicular to each other. Further, when the second golf club head is positioned in the second club address configuration, the second club top-to-bottom axis is approximately perpendicular to a second ground plane, and/or the second golf club head can comprise a second club loft angle less than approximately 55 degrees. Further still, each second club groove, respectively, of the at least one second club groove comprises a second club groove base, a second club groove sidewall adjacent to the second club groove base, a second club groove edge point, a second club groove edge radius at the second club groove edge point, and a second club groove central axis approximately perpendicular to the second club groove base. Even further still, the at least one second club groove can be symmetric across the second club groove central axis in a second club cross plane, and the second club cross plane can be approximately parallel to a second cross plane formed by the second club top-to-bottom axis and the second club front-to-rear axis. Also, the second club edge point can satisfy the Thirty Degree Rule, the second club groove base can comprise a second groove base width approximately parallel to the second club face surface and extending approximately perpendicular to the second club heel-to-toe axis, and the second club groove sidewall can form a second club groove sidewall angle with the second club groove central axis.

In these or other embodiments, the first club groove edge radius can be less than the second club groove edge radius; the first club groove base width can be less than the second club groove base width; and/or the first club groove sidewall angle can be greater than the second club groove sidewall angle.

Other embodiments include a method of providing a set of golf club heads. The method can comprise: providing a first golf club head; and providing a second golf club head.

Meanwhile, providing the first golf club head can comprise providing a first club head body of the first golf club head, providing the first club head body can comprise providing a first club face portion of the first club head body, the first club face portion can be located at the first front end, and providing the first club face portion can comprise providing a first club face surface of the first club face portion and at least one first club groove of the first club face portion. The first golf club head can comprise: (i) a first top end and a first bottom end opposite the first top end; (ii) a first front end and a first rear end opposite the first front end; (iii) a first toe end and a first heel end opposite the first toe end; (iv) a first club head body comprising a first club face portion; (v) a first club shaft axis comprising a first club top-to-bottom extending between the first top end and the first bottom end, a first club front-to-axis rear axis extending between the first front end and first rear end, and a first club heel-to-toe axis extending between the first heel end and the first toe end; and (vi) a first club address configuration.

Further, the first club top-to-bottom axis, the first club front-to-rear axis, and the first club heel-to-toe axis can be approximately perpendicular to each other. Meanwhile, when the first golf club head is positioned in the first club address configuration, the first club top-to-bottom axis can be approximately perpendicular to a first ground plane, and/or the first golf club head can comprise a first club loft angle greater than or equal to approximately 55 and less than or equal to approximately 65 degrees. Each first club groove, respectively, of the at least one first club groove can comprise a first club groove base, a first club groove sidewall adjacent to the first club groove base, a first club groove edge point, a first club groove edge radius at the first club groove edge point, a first club groove central axis approximately perpendicular to the first club groove base, and a first club groove length extending approximately parallel to the first club heel-to-toe axis. The first club groove base can comprise a first groove base width approximately parallel to the first club face surface and extending approximately perpendicular to the first club heel-to-toe axis, the first club groove central axis can intersect a first approximate midpoint of the first groove base width, the at least one first club groove can be approximately symmetric across the first club groove central axis along a first majority of the first club groove length, the first club edge point can satisfy a Thirty Degree Rule, and the first club groove sidewall can form a first club groove sidewall angle with the first club groove central axis.

Also, providing the second golf club head can comprise providing a second club head body of the second golf club head, providing the second club head body can comprise providing a second club face portion of the second club head body, the second club face portion being located at the second front end, and providing the second club face portion can comprise providing a second club face surface of the second club face portion and at least one second club groove of the second club face portion. The second golf club head can comprise: (i) a second top end and a second bottom end opposite the second top end; (ii) a second front end and a second rear end opposite the second front end; (iii) a second toe end and a second heel end opposite the second toe end; (iv) a second club head body comprising a second club face portion; (v) a second club shaft axis comprising a second club top-to-bottom axis extending between the second top end and the second bottom end, a second club front-to-rear axis extending between the second front end and second rear end, and a second club heel-to-toe axis extending between the second heel end and the second toe end; and (vi) a second club address configuration.

Further, the second club top-to-bottom axis, the second club front-to-rear axis, and the second club heel-to-toe axis can be approximately perpendicular to each other. Meanwhile, when the second golf club head is positioned in the second club address configuration, the second club top-to-bottom axis can be approximately perpendicular to a second ground plane, and/or the second golf club head can comprise a second club loft angle less than approximately 55 degrees. Each second club groove, respectively, of the at least one second club groove can comprise a second club groove base, a second club groove sidewall adjacent to the second club groove base, a second club groove edge point, a second club groove edge radius at the second club groove edge point, a second club groove central axis approximately perpendicular to the second club groove base, and a second club groove length extending approximately parallel to the second club heel-to-toe axis. The second club groove base can comprise a second groove base width approximately parallel to the second club face surface and extending approximately perpendicular to the second club heel-to-toe axis, the second club groove central axis can intersect a second approximate midpoint of the second groove base width, the at least one second club groove can be approximately symmetric across the second club groove central axis along a second majority of the second club groove length, the second club edge point can satisfy the Thirty Degree Rule, and the second club groove sidewall can form a second club groove sidewall angle with the second club groove central axis.

In these or other embodiments, the first club groove edge radius can be less than the second club groove edge radius; the first club groove base width can be less than the second club groove base width; and/or the first club groove sidewall angle can be greater than the second club groove sidewall angle.

Further embodiments include a set of golf club heads. The set comprises (i) a first golf club head comprising a first club head body comprising a first club face portion, and (ii) a second golf club head comprising a second club head body comprising a second club face portion.

Further, the first club face portion can comprise a first club face surface and at least one first club groove, and the first golf club head can comprise a first club loft angle greater than or equal to approximately 55 degrees. Each first club groove, respectively, of the at least one first club groove can comprise a first club groove base, a first club groove sidewall adjacent to the first club groove base, a first club groove edge point, a first club groove edge radius at the first club groove edge point, and a first club groove central axis approximately perpendicular to the first club groove base. The first club groove base can comprise a first groove base width, and the first club groove sidewall can form a first club groove sidewall angle.

Further still, the second club face portion can comprise a second club face surface and at least one second club groove, and the second golf club head can comprise a second club loft angle less than approximately 55 degrees. Each second club groove, respectively, of the at least one second club groove can comprise a second club groove base, a second club groove sidewall adjacent to the second club groove base, a second club groove edge point, a second club groove edge radius at the second club groove edge point, and a second club groove central axis approximately perpendicular to the second club groove base. The second club groove base can comprise a second groove base width, and the second club groove sidewall can form a second club groove sidewall angle.

In these or other embodiments, the first club groove edge radius can be less than the second club groove edge radius; the first club groove base width can be less than the second club groove base width; and/or the first club groove sidewall angle can be greater than the second club groove sidewall angle.

Figure 2:
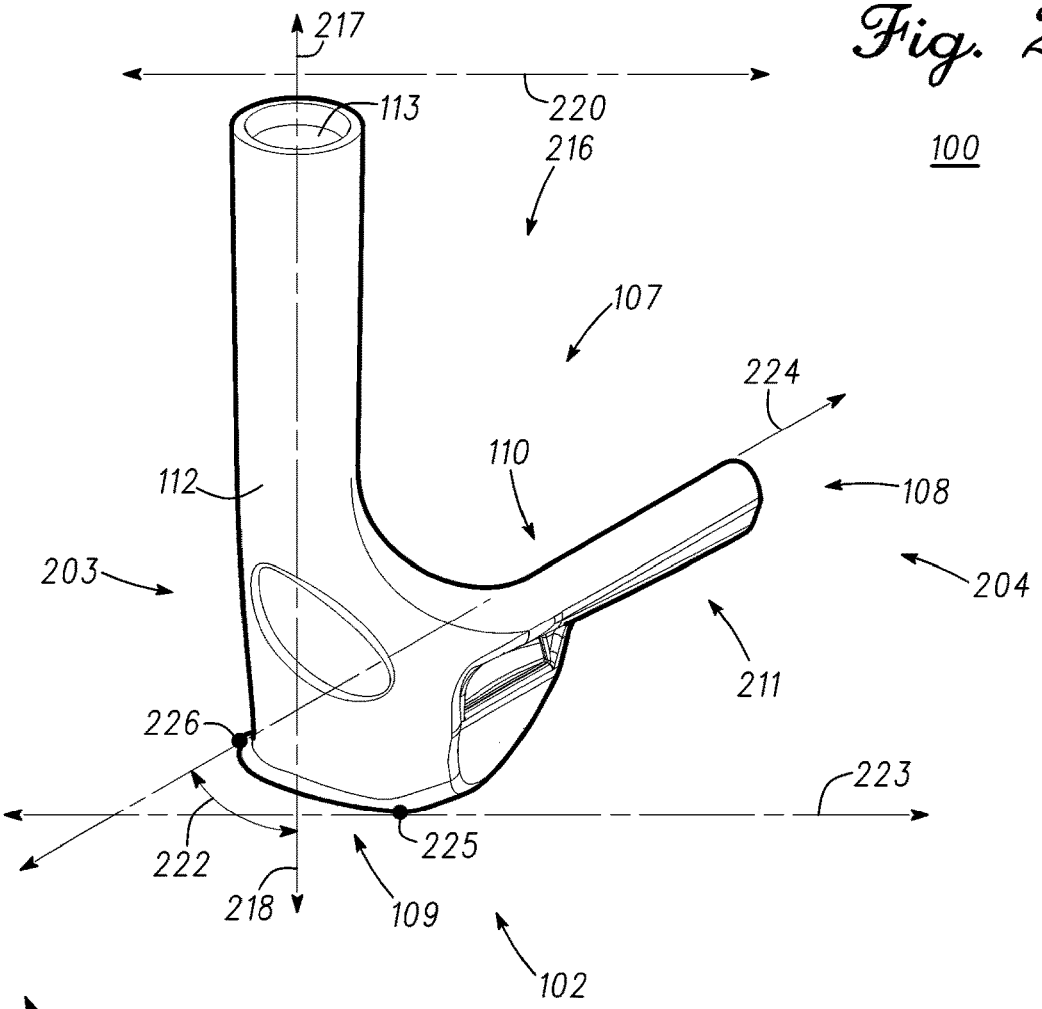
FIG. 2 illustrates a heel side view of the club head of FIG. 1.
Figure 3:
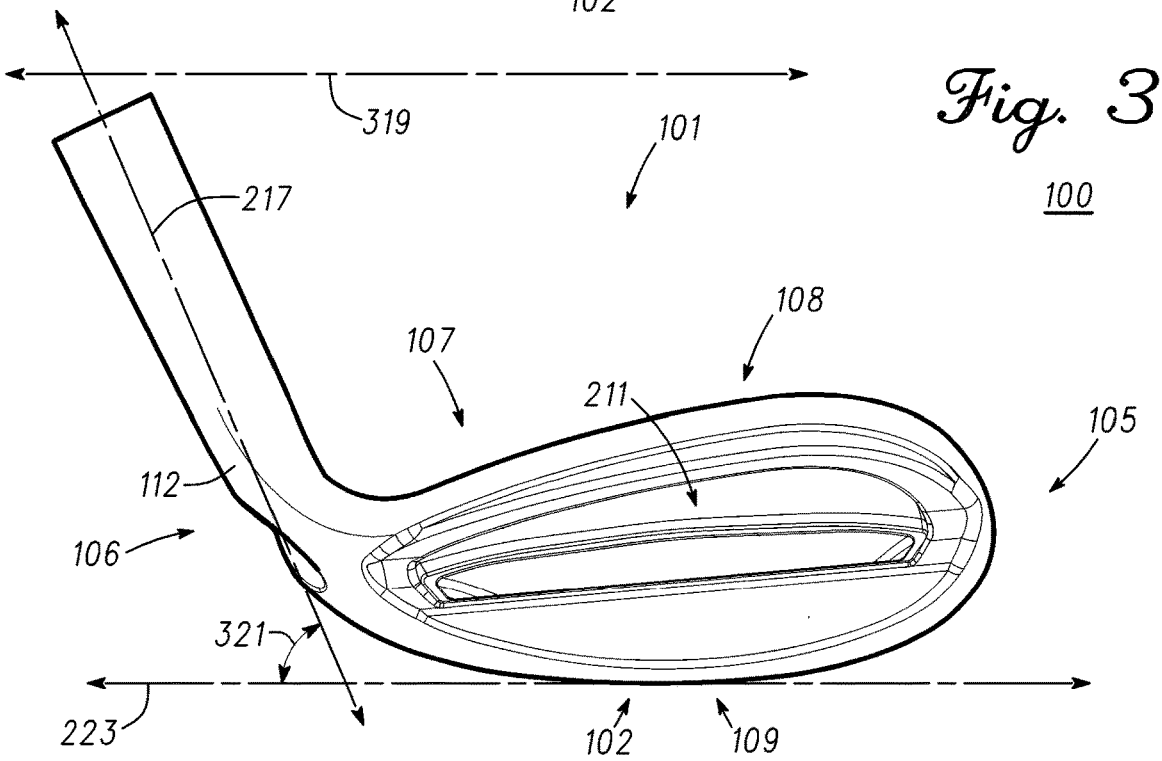
FIG. 3 illustrates a rear view of the club head of FIG. 1.

Turning to the drawings, FIGS. 1-3 illustrate front, heel side, and rear views of a club head 100, according to an embodiment. Club head 100 is merely exemplary and is not limited to the embodiments presented herein. Club head 100 can be employed in many different embodiments or examples not specifically depicted or described herein.

Generally, club head 100 can comprise a golf club head. For example, club head 100 can comprise any suitable iron-type golf club head. In some embodiments, club head 100 can comprise a muscle-back iron-type golf club head or cavity-back iron-type golf club head. In further embodiments, club head 100 can comprise any suitable wedge iron-type golf club head. Nonetheless, although club head 100 is generally described with respect to a iron-type golf club head, club head 100 can comprise any other suitable type of golf club head, such as, for example, a wood-type golf club head (e.g., a driver club head, a fairway wood club head, a hybrid club head, etc.) or a putter golf club head. Generally, club head 100 can comprise any suitable materials, but in many embodiments, club head 100 comprises one or more metal materials. Exemplary metal materials can comprise 17-4 stainless steel, 431 stainless steel, 8620 carbon steel, and/or 1025 carbon steel. Notwithstanding the foregoing, the apparatus, methods, and articles of manufacture described herein are not limited in this regard.

Referring to FIG. 1, club head 100 comprises a top end 101, a bottom end 102 opposite top end 101, a front end 203 (FIG. 2), a rear end 204 (FIG. 2) opposite front end 203, a toe end 105, and a heel end 106 opposite toe end 105. Further, club head 100 comprises a club head body 107. Club head body 107 can be solid, hollow, or partially hollow. When club head body 107 is hollow and/or partially hollow, club head body 107 can comprise a shell structure, and further, can be filled and/or partially filled with a filler material different from a material of shell structure. For example, the filler material can comprise plastic foam.

Meanwhile, club head body 107 can comprise a top portion 108, which can be referred to as a top rail, a sole portion 109, a face portion 110, and a rear portion 211 (FIG. 2). Further, face portion 110 can comprise a face surface 114 and one or more grooves 115. For example, groove(s) 115 can comprise groove 127. Further, club head body 107 can comprise hosel 112 or any other suitable mechanism (e.g., a bore) for receiving and coupling a shaft to club head 100 and/or club head body 107. In some embodiments, rear portion 211 (FIG. 2) can comprise a custom tuning port, which can be configured to receive one or more weights. In other embodiments, the customer tuning port can be omitted. In the same or different embodiments, the other suitable mechanism(s) can be similar to hosel 112 in one or more respects.

In many embodiments, hosel 112 can be located at or proximate to heel end 106. Although a shaft is not illustrated at the drawings, hosel 112 can be configured to receive a shaft (i.e., via an opening 113 of hosel 112), such as, for example, a golf club shaft. Accordingly, hosel 112 can receive the shaft and permit the shaft to be coupled (e.g., permanently or removably) to club head 100 and/or club head body 107 when hosel 112 receives the shaft.

Face portion 110 can be located at front end 203 (FIG. 2) and rear portion 211 (FIG. 2) can be located at rear end 204 (FIG. 2). Face portion 110 can be approximately opposite rear surface 211 (FIG. 2). Meanwhile, top portion 108 can be located at least partially at top end 101, and top portion 108 can interface with face portion 110 and rear portion 211 (FIG. 2) at top end 101. Further, sole portion 109 can be located at least partially at bottom end 102, and sole portion 109 can interface with face portion 110 and rear portion 211 (FIG. 2) at bottom end 102. In many examples, the interfaces of (a) top portion 108 with face portion 110 and/or rear portion 211 (FIG. 2) and/or (b) sole portion 109 with face portion 110 and/or rear portion 211 can be curved or faceted, providing smooth (or substantially smooth) transitions (a) top portion 108 with face portion 110 and/or rear portion 211 (FIG. 2) and/or (b) sole portion 109 with face portion 110 and/or rear portion 211. In other embodiments, the interfaces of (a) top portion 108 with face portion 110 and/or rear portion 211 (FIG. 2) and/or (b) sole portion 109 with face portion 110 and/or rear portion 211 can be angular, providing sharp transitions (a) top portion 108 with face portion 110 and/or rear portion 211 and/or (b) sole portion 109 with face portion 110 and/or rear portion 211.

Face portion 110 can refer to a strike face or a strike plate of club head 100, and can be configured to impact a ball (not shown), such as, for example, a golf ball. In many embodiments, face surface 114 can refer to a land area of face portion 110. In these or other embodiments, groove(s) 115 can extend between toe end 105 and heel end 106. Further, when groove(s) 115 comprise multiple grooves, two or more grooves of groove(s) 115 can be approximately parallel to each other.

Referring to FIG. 2, in operation, club head 100 can be positioned in an address configuration 216. In some embodiments, address configuration 216 can refer to a configuration of club head 100 in which club head 100 is positioned to address a golf ball (e.g., by a user as part of a golf club) while club head 100 is in a resting state. Further, in these or other embodiments, address configuration 216 can refer to a configuration of club head 100 in which club head 100 is balanced (e.g., at sole portion 109 (FIG. 1)) on a level surface (e.g., a ground surface) and acted upon only by gravity. Further still, in these or other embodiments, club head 100 can be decoupled from the shaft.

For reference purposes, at address configuration 216, club head 100 can comprise shaft axis 217. Shaft axis 217 can refer to a reference axis (a) that can be orthogonal to opening 113 and (b) that can intersect a center point of opening 113. When a shaft is coupled to club head body 107, the shaft and the shaft axis can be approximately parallel and/or co-linear.

Shaft axis 217 comprises a top-to-bottom axis 218, a heel-to-toe axis 319 (FIG. 3), and a front-to-rear axis 220. Top-to-bottom axis 218, heel-to-toe axis 319 (FIG. 3), and front-to-rear axis 220 can provide a Cartesian reference frame for club head 100 as component axes of shaft axis 217. In these embodiments, top-to-bottom axis 218, heel-to-toe axis 319 (FIG. 3), and front-to-rear axis 220 each can be orthogonal to each other. Further, top-to-bottom axis 218 can extend approximately in a direction of top end 101 (FIG. 1) and bottom end 102 (FIG. 1); heel-to-toe axis 319 (FIG. 3) can extend approximately in a direction of heel end 106 (FIG. 1) and toe end 105 (FIG. 1); and/or front-to-rear axis 220 can extend approximately in a direction of front end 203 and rear end 204.

Meanwhile, club head 100 can comprise a lie angle 321 (FIG. 3) and a loft angle 222. In these embodiments, shaft axis 217 can form lie angle 321 with a ground plane 223, and a loft plane 224 can form loft angle 222 with shaft axis 217. Further, club head 100 can comprise one or more keel points 225 and one or more leading edge points 226. Further still, top-to-bottom axis 218 can be approximately orthogonal to ground plane 223, heel-to-toe axis 319 (FIG. 3) can be approximately parallel to ground plane 223, and/or front-to-rear axis 220 can be approximately parallel to ground plane 223.

Ground plane 223 can refer to a plane (a) that is parallel to a plane including heel-to-toe axis 319 (FIG. 3) and front-to-rear axis 220 when club head 100 is positioned in address configuration 216 and (b) that intersects or is tangent to keel point(s) 225. Meanwhile, keel point(s) 225 can refer to the point or points of sole portion 109 closest to bottom end 102 and farthest from top end 101 when club head 100 is positioned in address configuration 216. Further, leading edge point(s) 226 can refer to the point or points of sole portion 109 that are closest to front end 203 and farthest from rear end 204 when club head 100 is positioned in address configuration 216. For purposes of clarity, keel point(s) 225 can comprise a single point in some examples, but also can comprise multiple points if each of the multiple points are equally close to bottom end 102 (FIG. 1) and far from top end 101 (FIG. 1), and leading edge point(s) 226 can comprise a single point in some examples, but also can comprise multiple points if each of the multiple points are equally close to front end 203 and far from rear end 204.

Meanwhile, loft plane 224 can refer to a plane (a) that intersects leading edge point(s) 226 and (b) that is approximately parallel with face portion 110 (FIG. 1) when club head 100 is positioned in address configuration 216. In these or other embodiments, loft plane 224 can refer to a plane (a) that intersects a face center of face portion 110 (FIG. 1) and (b) that is approximately parallel with face portion 110 when club head 100 is positioned in address configuration 216. In many examples, the face center can refer to a location at face portion 110 (FIG. 1) that is equidistant between toe end 105 (FIG. 1) and heel end 106 (FIG. 1) and further that is equidistant between top end 101 (FIG. 1) and bottom end 102 (FIG. 1). In various examples, the face center can refer to the face center as defined at *United States Golf Association: Procedure for Measuring the Flexibility of a Golf Clubhead*, USGA-TPX 3004, Revision 1.0.0, p. 6, May 1, 2008 (retrieved Aug. 24, 2014 from http://www.usga.org/equipment/testing/protocols/Test-Protocols-For-Equipment), which is incorporated herein by reference. When face portion 110 (FIG. 1) is planar and/or substantially planar, face portion 110 and loft plane 224 can be approximately co-planar. Meanwhile, when face portion 110 (FIG. 1) is non-planar (e.g., curved), at least part of face portion 110 can be located in front of or behind loft plane 224.

In many embodiments, a type of club head of club head 100 can be identified according to loft angle 222. In these or other embodiments, loft angle 222 can be greater than or equal to approximately 0 degrees and less than or equal to approximately 65 degrees. When club head 100 comprises a wedge iron-type golf club head, loft angle 222 can be greater than or equal to approximately 45 degrees and less than or equal to approximately 65 degrees. Further, lie angle 321 (FIG. 3) can be greater than or equal to approximately 50 degrees and less than or equal to approximately 60 degrees.

Figure 4:
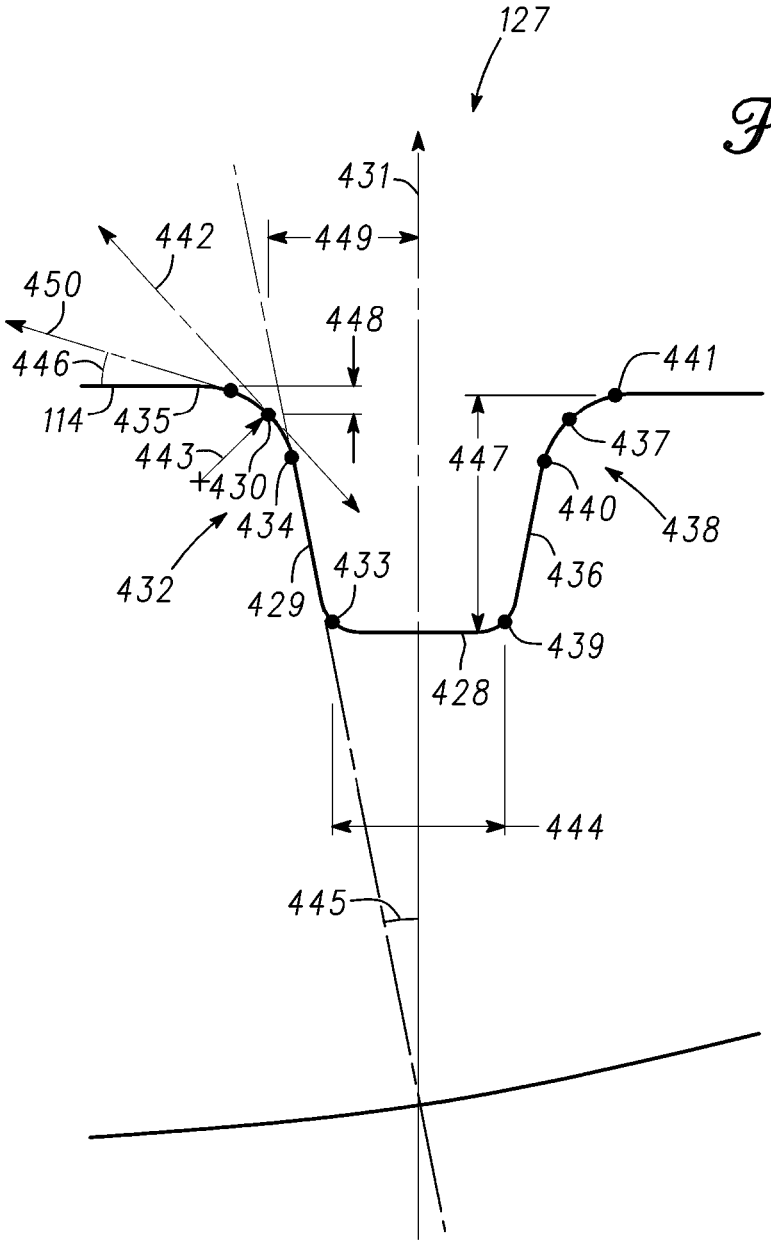
FIG. 4 illustrates a cross sectional view of part of the club head of FIG. 1 taken at section lines 1-1 in FIG. 1 to show a cross section of a groove of the club head.

Turning ahead in the drawings, FIG. 4 illustrates a cross sectional view of part of club head 100 taken at section lines 1-1 in FIG. 1 to show a cross section of groove 127 of club head 100. Notably, when groove(s) 115 (FIG. 1) comprise multiple grooves, each groove of groove(s) 115 (e.g., groove 127) can be similar or identical to each other.

Groove 127 can comprise groove base 428, groove sidewall 429, groove edge point 430, and groove central axis 431. Further, groove 127 can comprise a groove length. Meanwhile, in some embodiments, club head 100 and/or face portion 110 can comprise a filleted transition 432. In these embodiments, filleted transition 432 can comprise groove edge point 430. Further, groove 127 can comprise at least part of filleted transition 432. In other embodiments, filleted transition 432 can be omitted.

Groove sidewall 429 is adjacent to groove base 428. For example, groove base 428 can interface with groove sidewall 429 at a base-sidewall point 433. Meanwhile, when applicable, filleted transition 432 can be located between groove sidewall 429 and face surface 114 (FIG. 1). Accordingly, groove sidewall 429 can interface with filleted transition 432 at a sidewall-transition point 434, and filleted transition 432 can interface with face surface 114 (FIG. 1) at transition-face surface point 435. In these embodiments, groove edge point 430 can be located at filleted transition 432 between sidewall-transition point 434 and transition-face surface point 435.

The groove length of groove 127 can refer to the length (e.g., longest) dimension of groove 127 and can extend approximately between toe end 105 and heel end 106. In these or other embodiments, when groove(s) 115 (FIG. 1) comprise multiple grooves, groove lengths of two or more grooves of the multiple grooves can be similar or identical, and/or groove lengths of two or more grooves of the multiple grooves can be different.

Further, groove central axis 431 can be approximately perpendicular to groove base 428. In many embodiments, groove 127 can be approximately symmetric across groove central axis 431 in a cross plane approximately parallel to a plane formed by top-to-bottom axis 218 (FIG. 2) and front-to-rear axis 220 (FIG. 2). In these or other embodiments, the cross section of section lines 1-1 of FIG. 1 can be taken in a plane approximately parallel and/or co-planar with the cross plane. In further embodiments, groove central axis 431 can intersect an approximate midpoint of a groove base width 444 (described below) and/or an approximate midpoint of the groove length of groove 127. In these embodiments, groove central axis 431 can approximately intersect a center point of groove base 428. Further, in these or other embodiments, groove 127 can be approximately symmetric across groove central axis along a portion, a majority, approximately all, or all of the groove length of groove 127. Accordingly, in these or other embodiments, one or more elements of groove 127 can be mirrored across groove central axis 431, such as, for example, due to the symmetry of groove 127 with respect to groove central axis 431.

For example, groove 127 can comprise a groove sidewall 436 opposite groove sidewall 429, a groove edge point 437 opposite groove edge point 430, a filleted transition 438 opposite filleted transition 432, a base-sidewall point 439 opposite base-sidewall point 433, a sidewall-transition point 440 opposite sidewall-transition point 434, and a transition-face surface point 441 opposite sidewall-face surface point 435. Further, groove sidewall 436 can be similar or identical to groove sidewall 429; groove edge point 437 can be similar or identical to groove edge point 430; filleted transition 438 can be similar or identical to filleted transition 432; base-sidewall point 439 can be similar or identical to base-sidewall 433; sidewall-transition point 440 can be similar or identical to sidewall-transition point 434; and transition-face surface point 441 can be similar or identical to sidewall-face surface point 435.

In many embodiments, groove edge point 430 can satisfy (e.g., comply with) the United States Golf Association's thirty degree method for measuring groove width (the "Thirty Degree Rule") as described at the United States Golf Association's Determination of Groove Conformance (Impact Area Markings (App II, 5c) Measurement Procedure) ruling, dated August 2008 and which is incorporated herein by reference. According to the United States Golf Association at Appendix B (30 Degree Method for Measuring Groove Width) of the Thirty Degree Rule, a groove in a face portion of a golf club head starts where there is a significant departure from the plane of the face surface (e.g., face surface 114 (FIG. 1)) of the face portion. More specifically, groove edge point 430 is positioned at a location of filleted transition 432 beginning at transition-face surface point 435 and moving toward sidewall-transition point 434 and (a) where a tangent line 442 drawn tangent to filleted transition 432 forms at least a 30 degree angle with face surface 114 (FIG. 1) or (b) where the location at filleted transition 432 is approximately 0.00762 centimeters below face surface 114, whichever occurs first. Accordingly, in these or other embodiments, groove edge points 430 and 437 can mark the boundaries of groove 117 (FIG. 1).

Further, groove 127 can comprise a groove edge radius 443, groove base width 444, a groove sidewall angle 445, a groove fade angle 446, a groove depth 447, a groove edge point depth 448, and a groove edge point width 449.

Groove edge radius 443 refers to a radius of curvature of filleted transition 432 at groove edge point 430. When filleted transition 432 is omitted, groove edge radius 443 can be omitted. In many embodiments, groove edge radius 443 can be greater than or equal to approximately 0.007 centimeters and less than or equal to approximately 0.026 centimeters. In some embodiments, groove edge radius 443 can be greater than or equal to approximately 0.007 centimeters and less than or equal to approximately 0.015 centimeters. In other embodiments, groove edge radius 443 can be greater than or equal to approximately 0.015 centimeters and less than or equal to approximately 0.026 centimeters. For example, in these or other embodiments, groove edge radius 443 can be approximately 0.007±0.005 centimeters, approximately 0.008±0.005 centimeters, approximately 0.009±0.005 centimeters, approximately 0.010±0.005 centimeters, approximately 0.011±0.005 centimeters, approximately 0.012±0.005 centimeters, approximately 0.013±0.005 centimeters, approximately 0.014±0.005 centimeters, approximately 0.015±0.005 centimeters, approximately 0.016±0.005 centimeters, approximately 0.017±0.005 centimeters, approximately 0.018±0.005 centimeters, approximately 0.019±0.005 centimeters, approximately 0.020±0.005 centimeters, approximately 0.021±0.005 centimeters, approximately 0.022±0.005 centimeters, approximately 0.023±0.005 centimeters, approximately 0.024±0.005 centimeters, approximately 0.025±0.005 centimeters, or approximately 0.026±0.005 centimeters.

For example, in many embodiments, when loft angle 222 (FIG. 2) is greater than approximately 55 degrees and less than or equal to approximately 65 degrees, groove edge radius 443 can be greater than or equal to approximately 0.007 centimeters and less than or equal to approximately 0.015 centimeters. In these or other embodiments, when loft angle 222 (FIG. 2) is greater than or equal to approximately 56 degrees and less than or equal to approximately 60 degrees, groove edge radius 443 can be greater than or equal to approximately 0.007 centimeters and less than or equal to approximately 0.015 centimeters.

Further, in many embodiments, when loft angle 222 (FIG. 2) is greater than or equal to approximately 45 degrees and less than or equal to approximately 55 degrees, groove edge radius 443 can be greater than or equal to approximately 0.015 centimeters and less than or equal to approximately 0.026 centimeters. In these or other embodiments, when loft angle 222 is greater than or equal to approximately 47 degrees and less than or equal to approximately 54 degrees, groove edge radius 443 can be greater than or equal to approximately 0.015 centimeters and less than or equal to approximately 0.026 centimeters.

Groove base width 444 refers to a width of groove base 428 measured approximately parallel to face surface 114 (FIG. 1) and approximately perpendicular to heel-to-toe axis 319 (FIG. 3). For example, groove base width 444 can refer to the cross sectional width of groove base 428 in the cross plane introduced above with respect to groove central axis 431. Further, groove base width 444 can refer to a distance between base-sidewall point 433 and base-sidewall point 439. In many embodiments, groove base width 444 can be greater than or equal to approximately 0.0350 centimeters and less than or equal to approximately 0.0414 centimeters. For example, in these or other embodiments, groove edge radius 443 can be approximately 0.0350±0.0025 centimeters, approximately 0.0352±0.0025 centimeters, approximately 0.0354±0.0025 centimeters, approximately 0.0356±0.0025 centimeters, approximately 0.0358±0.0025 centimeters, approximately 0.0360±0.0025 centimeters, approximately 0.0362±0.0025 centimeters, approximately 0.0364±0.0025 centimeters, approximately 0.0366±0.0025 centimeters, approximately 0.0368±0.0025 centimeters, approximately 0.0370±0.0025 centimeters, approximately 0.0372±0.0025 centimeters, approximately 0.0374±0.0025 centimeters, approximately 0.0376±0.0025 centimeters, approximately 0.0378±0.0025 centimeters, approximately 0.0380±0.0025 centimeters, approximately 0.0382±0.0025 centimeters, approximately 0.0384±0.0025 centimeters, approximately 0.0386±0.0025 centimeters, approximately 0.0388±0.0025 centimeters, approximately 0.0390±0.0025 centimeters, approximately 0.0392±0.0025 centimeters, approximately 0.0394±0.0025 centimeters, approximately 0.0396±0.0025 centimeters, approximately 0.0398±0.0025 centimeters, approximately 0.0400±0.0025 centimeters, approximately 0.0402±0.0025 centimeters, approximately 0.0404±0.0025 centimeters, approximately 0.0406±0.0025 centimeters, approximately 0.0408±0.0025 centimeters, approximately 0.0410±0.0025 centimeters, approximately 0.0412±0.0025 centimeters, approximately 0.0414±0.0025 centimeters.

For example, in many embodiments, when loft angle 222 (FIG. 2) is greater than approximately 55 degrees and less than or equal to approximately 65 degrees, groove base width 444 can be approximately 0.0350±0.0025 centimeters. In these or other embodiments, when loft angle 222 is greater than or equal to approximately 56 degrees and less than or equal to approximately 60 degrees, groove base width 444 can be approximately 0.0350±0.0025 centimeters.

Further, in many embodiments, when loft angle 222 (FIG. 2) is greater than or equal to approximately 45 degrees and less than or equal to approximately 55 degrees, groove base width 444 can be approximately 0.0414±0.0025 centimeters. In these or other embodiments, when loft angle 222 is greater than or equal to approximately 47 degrees and less than or equal to approximately 54 degrees, groove base width 444 can be approximately 0.0414±0.0025 centimeters.

Groove sidewall angle 445 refers to an angle that groove sidewall 429 forms with groove central axis 431. In many embodiments, groove sidewall angle 445 can be greater than or equal to approximately 13 degrees and less than or equal to approximately 27 degrees. In some embodiments, groove sidewall angle 445 can be greater than or equal to approximately 13 degrees and less than or equal to approximately 19 degrees. In other embodiments, groove sidewall angle 445 can be greater than or equal to approximately 21 degrees and less than or equal to approximately 27 degrees. For example, in these or other embodiments, groove side wall angle 445 can be approximately 13±1 degrees, approximately 14±1 degrees, approximately 15±1 degrees, approximately 16±1 degrees, approximately 17±1 degrees, approximately 18±1 degrees, approximately 19±1 degrees, approximately 20±1 degrees, approximately 21±1 degrees, approximately 22±1 degrees, approximately 23±1 degrees, approximately 24±1 degrees, approximately 25±1 degrees, approximately 26±1 degrees, or approximately 27±1 degrees.

For example, in many embodiments, when loft angle 222 (FIG. 2) is greater than approximately 55 degrees and less than or equal to approximately 65 degrees, groove sidewall angle 445 can be greater than or equal to approximately 21 degrees and less than or equal to approximately 27 degrees. In these or other embodiments, when loft angle 222 is greater than or equal to approximately 56 degrees and less than or equal to approximately 60 degrees, groove sidewall angle 445 can be greater than or equal to approximately 21 degrees and less than or equal to approximately 27 degrees.

Further, in many embodiments, when loft angle 222 (FIG. 2) is greater than or equal to approximately 45 degrees and less than or equal to approximately 55 degrees, groove sidewall angle 445 can be greater than or equal to approximately 13 degrees and less than or equal to approximately 19 degrees. In these or other embodiments, when loft angle 222 is greater than or equal to approximately 47 degrees and less than or equal to approximately 54 degrees, groove sidewall angle 445 can be greater than or equal to approximately 13 degrees and less than or equal to approximately 19 degrees.

Meanwhile, groove fade angle 446 refers to an angle that a tangent line 450 at transition-face surface point 435 forms with face surface 114 (FIG. 1). In many embodiments, groove fade angle 446 can be approximately 12 degrees.

Groove depth 447 refers to a distance between face surface 114 (FIG. 1) and groove base 428 measured approximately parallel to groove central axis 431 and approximately perpendicular to groove base 428 and/or face surface 114 (FIG. 1). Notably, groove depth 447 can be constant across groove base 428. In these embodiments, groove depth 447 can be measured at any location along groove base 428. In other embodiments, groove depth 447 can be measured approximately at a center point of groove base 428 (e.g., where groove central axis 431 intersects groove base 428). In many embodiments, groove depth 447 can be approximately 0.04±0.0025 centimeters.

Groove edge point depth 448 refers to a distance between groove edge point 430 and face surface 114 (FIG. 1) measured approximately parallel to groove central axis 431, and approximately perpendicular to face surface 114 (FIG. 1) and/or groove base 428. Notably, when groove edge point 430 satisfies the Thirty Degree Rule by depth below face surface 114 (FIG. 1) as opposed to by tangent line 442 forming at least a 30 degree angle, as described above, groove edge point depth 448 is approximately 0.00762±0.0013 centimeters regardless of loft angle 222 (FIG. 2). In other embodiments, groove edge point depth can be approximately 0.004±0.0013 centimeters regardless of loft angle 222 (FIG. 2). It may also be noted that an effective groove depth (i.e., a distance between groove edge point 430 and groove base 428 measured approximately parallel to groove central axis 431 and approximately perpendicular to groove base 428 and/or face surface 114 (FIG. 1)) of groove 127 can be determined by subtracting groove edge point depth 448 from groove depth 447.

Groove edge point width 449 refers to a distance between groove edge point 430 and groove central axis 431 measured approximately perpendicular to groove central axis 431 and approximately parallel to groove base 428 and/or face surface 114 (FIG. 1). Meanwhile, a groove width (not shown) can refer to a distance between groove edge points 430 and 437 measured approximately perpendicular to groove central axis 431 and approximately parallel to groove base 428 and/or face surface 114 (FIG. 1). In many embodiments, groove edge point width 449 can be approximately 0.037±0.005 centimeters regardless of loft angle 222 (FIG. 2). Accordingly, the groove width can be double groove edge point width 449.

Referring now back to FIG. 1, when groove(s) 115 comprise multiple grooves, adjacent grooves of groove(s) 115 (e.g., groove 127) can be spaced apart by a pitch, such as, for example, as measured approximately parallel to top-to-bottom axis 218 (FIG. 2) and/or between the central axis (e.g., central axis 431 (FIG. 4)) of the adjacent grooves of groove(s) 115. In many embodiments, the pitch between two or more adjacent grooves of groove(s) 115 can be approximately equal to the pitch between two or more other adjacent grooves of groove(s) 115 within a single club head (e.g., club head 100 (FIGS. 1-3). In these or other embodiments, the pitch between two or more adjacent grooves of groove(s) 115 can be different than the pitch between two or more other adjacent grooves of groove(s) 115 within a single club head (e.g., club head 100 (FIGS. 1-3).

In many embodiments, the pitch of some or all adjacent grooves of a single club head (e.g., club head 100 (FIGS. 1-3)) can be greater than or equal to approximately 0.330±0.005 centimeters and less than or equal to approximately 0.366±0.005 centimeters. For example, in these or other embodiments, the pitch of some or all adjacent grooves of a single club head (e.g., club head 100 (FIGS. 1-3)) can be approximately 0.330±0.005 centimeters, approximately 0.331±0.005 centimeters, approximately 0.332±0.005 centimeters, approximately 0.333±0.005 centimeters, approximately 0.334±0.005 centimeters, approximately 0.335±0.005 centimeters, approximately 0.336±0.005 centimeters, approximately 0.337±0.005 centimeters, approximately 0.338±0.005 centimeters, approximately 0.339±0.005 centimeters, approximately 0.340±0.005 centimeters, approximately 0.341±0.005 centimeters, approximately 0.342±0.005 centimeters, approximately 0.343±0.005 centimeters, approximately 0.344±0.005 centimeters, approximately 0.345±0.005 centimeters, approximately 0.346±0.005 centimeters, approximately 0.347±0.005 centimeters, approximately 0.348±0.005 centimeters, approximately 0.349±0.005 centimeters, approximately 0.350±0.005 centimeters, approximately 0.351±0.005 centimeters, approximately 0.352±0.005 centimeters, approximately 0.353±0.005 centimeters, approximately 0.354±0.005 centimeters, approximately 0.355±0.005 centimeters, approximately 0.356±0.005 centimeters, approximately 0.357±0.005 centimeters, approximately 0.358±0.005 centimeters, approximately 0.359±0.005 centimeters, approximately 0.360±0.005 centimeters, approximately 0.361±0.005 centimeters, approximately 0.362±0.005 centimeters, approximately 0.363±0.005 centimeters, approximately 0.364±0.005 centimeters, approximately 0.365±0.005 centimeters, or approximately 0.366±0.005 centimeters.

For example, in many embodiments, when loft angle 222 (FIG. 2) is greater than approximately 55 degrees and less than or equal to approximately 65 degrees, the pitch of some or all adjacent grooves of a single club head (e.g., club head 100 (FIGS. 1-3)) can be greater than or equal to approximately 0.330±0.005 centimeters and less than or equal to approximately 0.345±0.005 centimeters. In these or other embodiments, when loft angle 222 is greater than or equal to approximately 56 degrees and less than or equal to approximately 60 degrees, the pitch of some or all adjacent grooves of a single club head (e.g., club head 100 (FIGS. 1-3)) can be greater than or equal to approximately 0.330±0.005 centimeters and less than or equal to approximately 0.345±0.005 centimeters.

Further, in many embodiments, when loft angle 222 (FIG. 2) is greater than or equal to approximately 45 degrees and less than or equal to approximately 55 degrees, the pitch can be greater than or equal to approximately 0.345±0.005 centimeters and less than or equal to approximately 0.366±0.005 centimeters. In these or other embodiments, when loft angle 222 is greater than or equal to approximately 47 degrees and less than or equal to approximately 54 degrees, the pitch can be greater than or equal to approximately 0.345±0.005 centimeters and less than or equal to approximately 0.366±0.005 centimeters.

Further, each groove of groove(s) 115 (e.g., groove 127) can comprise a cross sectional area of the groove taken in the cross plane as introduced above with respect to groove central axis 431 (FIG. 4). When groove(s) 115 comprise multiple grooves, each groove of groove(s) 115 can comprise an area to pitch ratio. In many embodiments, the area to pitch ratio can be approximately constant between two or more of groove(s) 115 regardless of loft angle 222 (FIG. 2). For example, the area to pitch ratio can be approximately 0.0068 centimeters regardless of loft angle 222 (FIG. 2).

When club head 100 comprises a golf club head, the golf club head can be part of a corresponding golf club. Further, the golf club head can be part of a set of golf club heads, and/or the golf club can be part of a set of golf clubs. In many embodiments, each golf club head of the set of golf club heads and/or each golf club of the set of golf clubs can be similar to each other. However, in these or other embodiments, the golf club heads of the set of golf club heads and/or the golf clubs of the set of golf clubs can comprise different loft angles.

For example, at least one golf club head of the set of golf club heads and/or at least one golf club of the set of golf clubs can comprise a loft angle less than approximately 45 degrees; meanwhile, at least one golf club head of the set of golf club heads and/or at least one golf club of the set of golf clubs can comprise a loft angle greater than or equal to approximately 45 degrees and/or less than or equal to approximately 65 degrees. In other examples, at least one golf club head of the set of golf club heads and/or at least one golf club of the set of golf clubs can comprise a loft angle less than approximately 55 degrees; meanwhile, at least one golf club head of the set of golf club heads and/or at least one golf club of the set of golf clubs can comprise a loft angle greater than or equal to approximately 55 degrees and/or less than or equal to approximately 65 degrees.

In these or other embodiments, the groove(s) (e.g., groove(s) 115) of a first golf club head (e.g., golf club head 100) and/or a first golf club of a set of golf clubs that comprises a higher loft angle (e.g., loft angle 222 (FIG. 2)) can comprise a smaller groove edge radius (e.g., groove edge radius 443 (FIG. 4)), a smaller groove base width (e.g., groove base width 444 (FIG. 4)), a larger groove sidewall angle (e.g., groove sidewall angle 445 (FIG. 4)), and/or a smaller pitch of the groove(s) than the groove(s) of a second golf club head and/or a second golf club of the set of golf clubs that comprises a lower loft angle. In these or other embodiments, other parameters (e.g., a groove depth (e.g., groove depth 447 (FIG. 4)), a groove edge point width (e.g., groove edge point width 449 (FIG. 4)) and/or a area to pitch ratio of the groove(s)) can be held approximately constant. Notably, the first golf club head and the second golf club head can be similar to each other. This relationship can exist across two or more (e.g., all) golf club heads and/or golf clubs of the set of golf clubs. In these or other embodiments, one or more of these elements can be constant between two or more of the golf club heads and/or golf clubs of the set of golf clubs. For example, in these or other embodiments, the first golf club head (e.g., golf club head 100) and/or the first golf club of the set of golf clubs can comprise a loft angle greater than or equal to approximately 45 degrees and/or less than or equal to approximately 65 degrees and the second golf club head and/or the second golf club of the set of golf clubs can be less than 45 degrees. In further embodiments, the first golf club head (e.g., golf club head 100) and/or the first golf club of the set of golf clubs can comprise a loft angle greater than or equal to approximately 55 degrees and/or less than or equal to approximately 65 degrees and the second golf club head and/or the second golf club of the set of golf clubs can be less than 55 degrees.

Meanwhile, in some specific embodiments, a first golf club head of the set of golf club heads and/or at least one golf club of the set of golf clubs can comprise a loft angle of approximately 45 degrees and can comprise one or more grooves each having a groove edge radius of approximately 0.017±0.005 centimeters, a groove base width of approximately 0.0414±0.0025 centimeters, and/or a groove sidewall angle of approximately 16±1 degrees; a second golf club head of the set of golf club heads and/or at least one golf club of the set of golf clubs can comprise a loft angle of approximately 46 degrees and can comprise one or more grooves each having a groove edge radius of approximately 0.017±0.005 centimeters, a groove base width of approximately 0.0414±0.0025 centimeters, and/or a groove sidewall angle of approximately 16±1 degrees; a third golf club head of the set of golf club heads and/or at least one golf club of the set of golf clubs can comprise a loft angle of approximately 47 degrees and can comprise one or more grooves each having a groove edge radius of approximately 0.017±0.005 centimeters, a groove base width of approximately 0.0414±0.0025 centimeters, and/or a groove sidewall angle of approximately 16±1 degrees; a fourth golf club head of the set of golf club heads and/or at least one golf club of the set of golf clubs can comprise a loft angle of approximately 50 degrees and can comprise one or more grooves each having a groove edge radius of approximately 0.017±0.005 centimeters, a groove base width of approximately 0.0414±0.0025 centimeters, and/or a groove sidewall angle of approximately 16±1 degrees; a fifth golf club head of the set of golf club heads and/or at least one golf club of the set of golf clubs can comprise a loft angle of approximately 52 degrees and can comprise one or more grooves each having a groove edge radius of approximately 0.017±0.005 centimeters, a groove base width of approximately 0.0414±0.0025 centimeters, and/or a groove sidewall angle of approximately 16±1 degrees; a sixth golf club head of the set of golf club heads and/or at least one golf club of the set of golf clubs can comprise a loft angle of approximately 54 degrees and can comprise one or more grooves each having a groove edge radius of approximately 0.017±0.005 centimeters, a groove base width of approximately 0.0414±0.0025 centimeters, and/or a groove sidewall angle of approximately 16±1 degrees; a seventh golf club head of the set of golf club heads and/or at least one golf club of the set of golf clubs can comprise a loft angle of approximately 56 degrees and can comprise one or more grooves each having a groove edge radius of approximately 0.011±0.005 centimeters, a groove base width of approximately 0.0350±0.0025 centimeters, and/or a groove sidewall angle of approximately 24±1 degrees; an eighth golf club head of the set of golf club heads and/or at least one golf club of the set of golf clubs can comprise a loft angle of approximately 58 degrees and can comprise one or more grooves each having a groove edge radius of approximately 0.011±0.005 centimeters, a groove base width of approximately 0.0350±0.0025 centimeters, and/or a groove sidewall angle of approximately 24±1 degrees; and/or a ninth golf club head of the set of golf club heads and/or at least one golf club of the set of golf clubs can comprise a loft angle of approximately 60 degrees and can comprise one or more grooves each having a groove edge radius of approximately 0.011±0.005 centimeters, a groove base width of approximately 0.0350±0.0025 centimeters, and/or a groove sidewall angle of approximately 24±1 degrees.

As discussed above, it may be desirable to impart a spin on a golf ball hit with a golf club head and/or golf club. However, in a conventional set of golf clubs, as loft angle increases, the golf ball has a tendency to slip up the face portion of the golf club heads of the golf clubs of the set so that spin on the golf ball decreases. Nonetheless, spin can be even more desirable when hitting golf balls with golf clubs of higher loft angles (e.g., loft angles greater than or equal to approximately 45 degrees and/or less than or equal to approximately 65 degrees, loft angles greater than or equal to approximately 55 degrees and/or less than or equal to approximately 65 degrees). By reducing the groove edge radius (e.g., groove edge radius 443 (FIG. 4)), reducing the groove base width (e.g., groove base width 444 (FIG. 4)), increasing the groove sidewall angle (e.g., groove sidewall angle 445 (FIG. 4)), and/or reducing the pitch of the groove(s) of the golf club heads and/or golf clubs of a set of golf clubs as the loft angle increases, the amount of spin imparted on a golf ball hit with the golf club heads and/or the golf clubs can be increased. In many examples, the groove edge radius can produce the largest effect on the spin imparted on the golf ball.

Figure 5:
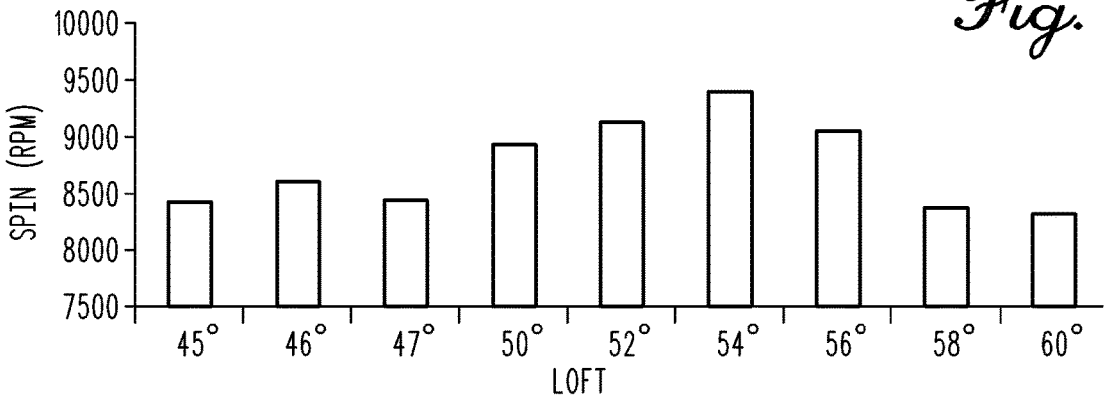
FIG. 5 illustrates the amount of spin imparted on a golf ball in rotations per minute by a set of iron-type golf club heads having grooves with constant groove edge radii as a function of a loft angle of the iron-type golf club heads.
Figure 6:
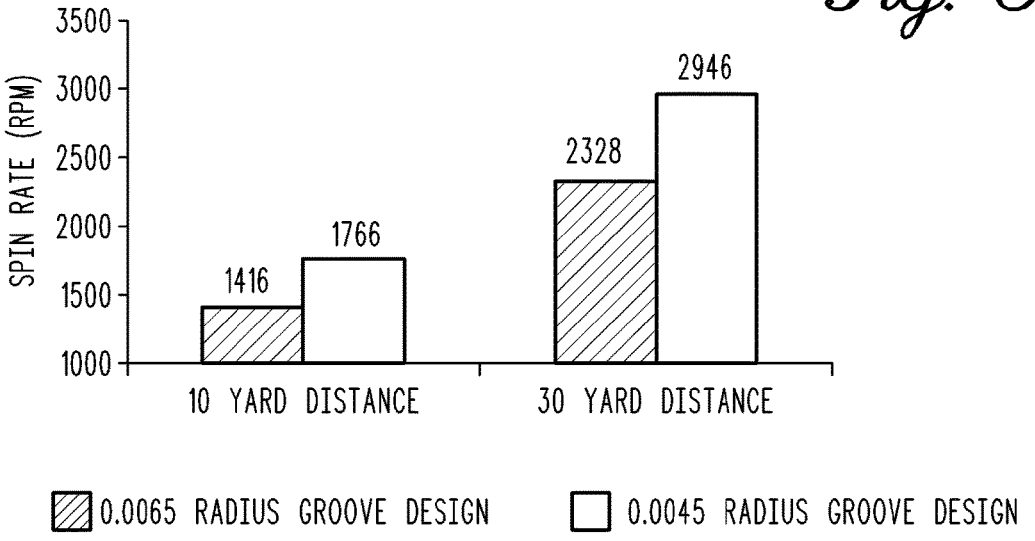
FIG. 6 illustrates the amount of spin imparted on a golf ball in rotations per minute for iron-type golf club heads of varying groove edge radii of an iron-type golf club head for multiple shot distances.
Figure 7:
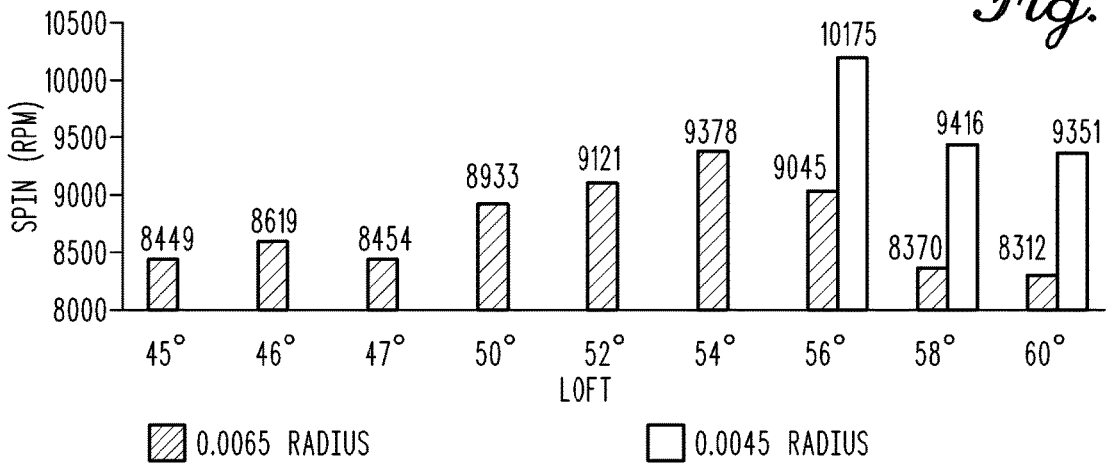
FIG. 7 illustrates the amount of spin imparted on a golf ball in rotations per minute for a set of iron-type golf club heads as a function of a loft angle and a groove edge radius of the iron-type golf club heads.

Turning ahead in the drawings, FIGS. 5-7 help to show how the amount of spin imparted on a golf ball hit with a golf club varies for varying groove edge radii and loft angles of the golf club. For example, FIG. 5 illustrates the amount of spin imparted on a golf ball in rotations per minute by a set of iron-type golf club heads having grooves with constant groove edge radii of approximately 0.0165 centimeters as a function of a loft angle of the iron-type golf club heads. The data in FIG. 5 (obtained using player testing) shows that the amount of spin imparted on the golf ball increases as a loft angle of the iron-type golf club heads up to a maximum spin at approximately 54 degrees of loft. However, for loft angles above greater than or equal to approximately 55 degrees, spin decreases as the loft angle increases.

Meanwhile, FIG. 6 illustrates the amount of spin imparted on a golf ball in rotations per minute for iron-type golf club heads of varying groove edge radii of an approximately 60 degree iron-type golf club head for a short (approximately 10 yard) and long (approximately 30 yard) shot. The data in FIG. 6 shows that decreasing the groove edge radius (from approximately 0.0165 centimeters to 0.0114 centimeters) results in increased spin on high lofted iron-type golf club heads. Overall, the amount of spin increased from approximately 1-30 percent depending on testing conditions (e.g. wet, dry, grass).

Further, FIG. 7 illustrates the amount of spin imparted on a golf ball in rotations per minute for a set of iron-type golf club heads as a function of a loft angle and a groove edge radius of the iron-type golf club heads. Here, the groove edge radius for iron-type golf club heads with lofts less than 55 degrees is 0.0165 centimeters, and the groove edge radius for clubs with loft angles greater than 55 degrees is 0.0114 centimeters). The data in FIG. 7 shows that decreasing the groove edge radius for loft angles greater than 55 degrees increase the spin imparted on a golf ball by 12.5 percent on average, compared to using a constant groove edge radius.

Figure 8:
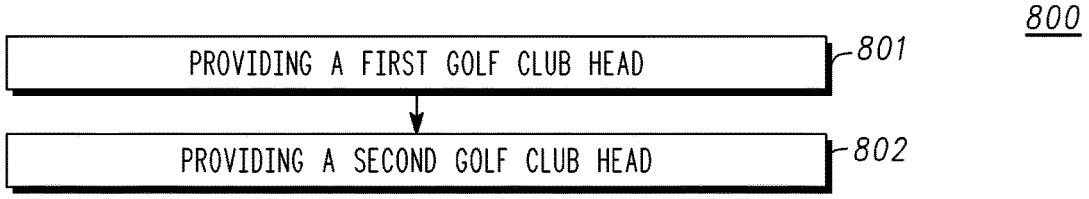
FIG. 8 illustrates an embodiment of a method of providing (e.g., manufacturing) a set of golf club heads.

FIG. 8 illustrates an embodiment of a method 800 of providing (e.g., manufacturing) a set of golf club heads. Method 800 is merely exemplary and is not limited to the embodiments presented herein. Method 800 can be employed in many different embodiments or examples not specifically depicted or described herein. In some embodiments, the activities of method 800 can be performed in the order presented. In other embodiments, the activities of method 800 can be performed in any other suitable order. In still other embodiments, one or more of the activities in method 800 can be combined or skipped. The set of golf club heads can be similar or identical to the set of golf club heads described above with respect to club head 100 (FIGS. 1-3). Meanwhile, one or more golf club heads of the set of golf club heads can be similar or identical to club head 100 (FIGS. 1-3).

In many embodiments, method 800 can comprise activity 801 of providing (e.g., forming) a first golf club head. The first golf club head can be similar or identical to club head 100 (FIG. 1). Accordingly, in many embodiments, performing activity 801 can comprise providing a first club head body of the first golf club head. Further, providing the first club head body can comprise providing a first club face portion of the first club head body. In these or other embodiments, the first club head body can be similar or identical to club head body 107 (FIG. 1); and the first club face portion can be similar or identical to face portion 110 (FIG. 1). In some embodiments, the first golf club head can comprise a first club loft angle greater than or equal to approximately 45 and less than or equal to approximately 65 degrees. In other embodiments, the first golf club head can comprise a first club loft angle greater than or equal to approximately 45 and less than or equal to approximately 55 degrees. In further embodiments, the first golf club head can comprise a first club loft angle greater than or equal to approximately 55 and less than or equal to approximately 65 degrees.

Figure 9:
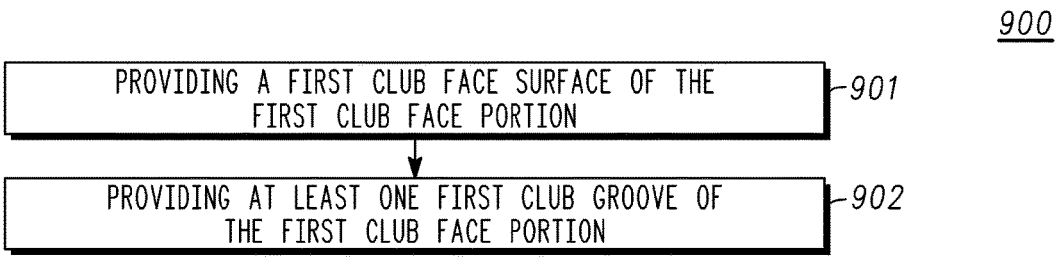
FIG. 9 illustrates an exemplary activity of providing a first club face portion of the first club head body of the first golf club head, according to the embodiment of FIG. 8.

Meanwhile, FIG. 9 illustrates an exemplary activity 900 of providing (e.g., forming) a first club face portion of the first club head body of the first golf club head, according to the embodiment of FIG. 8.

For example, activity 900 can comprise activity 901 of providing (e.g., forming) a first club face surface of the first club face portion. In many embodiments, the first club face surface can be similar or identical to face surface 114 (FIG. 1).

Figure 10:
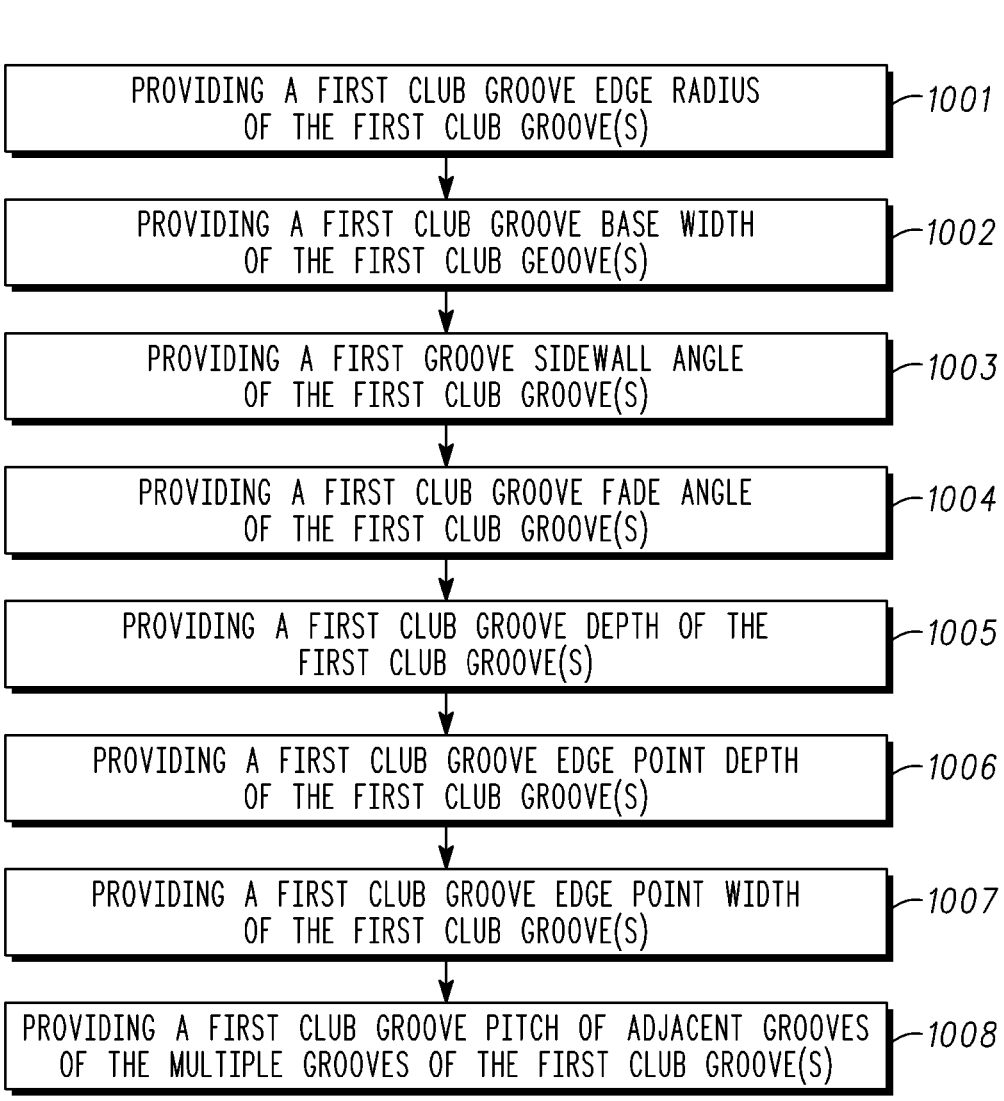
FIG. 10 illustrates an exemplary activity of providing at least one first club groove of the first club face portion, according to the embodiment of FIG. 8.

Further, activity 900 can comprise activity 902 of providing (e.g., forming) at least one first club groove of the first club face portion. In many embodiments, the groove(s) can be similar or identical to groove(s) 115 (FIG. 1) and/or groove 127 (FIGS. 1 & 4). In some embodiments, activities 901 and 902 and be performed simultaneously with each other such as when the golf club face and at least one first club groove are cast, forged, molded, or otherwise formed when the rest of the golf club head is cast, forged, molded, or otherwise formed. In other embodiments, activities 901 and 902 are performed sequentially such that the golf club face is cast, forged, molded, or otherwise formed with other portions of the golf club head, but the grooves are machined, drilled, laser cut, or otherwise formed into the golf club face after the casting, forging, molding, or other forming process. FIG. 10 illustrates an exemplary activity 902, according to the embodiment of FIG. 8.

For example, in many embodiments, activity 902 can comprise activity 1001 of providing (e.g., forming) a first club groove edge radius of the first club groove(s). In some embodiments, the first club groove edge radius can be similar or identical to groove edge radius 443 (FIG. 4).

In many embodiments, activity 902 can comprise activity 1002 of providing (e.g., forming) a first club groove base width of the first club groove(s). In some embodiments, the first club groove base width can be similar or identical to groove base width 444 (FIG. 4).

In many embodiments, activity 902 can comprise activity 1003 of providing (e.g., forming) a first club groove sidewall angle of the first club groove(s). In some embodiments, the first club groove sidewall angle can be similar or identical to groove sidewall angle 445 (FIG. 4).

In many embodiments, activity 902 can comprise activity 1004 of providing (e.g., forming) a first club groove fade angle of the first club groove(s). In some embodiments, the first club groove fade angle can be similar or identical to groove fade angle 446 (FIG. 4).

In many embodiments, activity 902 can comprise activity 1005 of providing (e.g., forming) a first club groove depth of the first club groove(s). In some embodiments, the first club groove depth can be similar or identical to groove depth 447 (FIG. 4).

In many embodiments, activity 902 can comprise activity 1006 of providing (e.g., forming) a first club groove edge point depth of the first club groove(s). In some embodiments, the first club groove edge point depth can be similar or identical to first groove edge point depth 448 (FIG. 4).

In many embodiments, activity 902 can comprise activity 1007 of providing (e.g., forming) a first club groove edge point width of the first club groove(s). In some embodiments, the first club groove edge point width can be similar or identical to first groove edge point width 449 (FIG. 4).

In some embodiments, when the first club groove(s) comprise multiple grooves, activity 902 can comprise activity 1008 of providing (e.g., forming) a first club groove pitch of adjacent grooves of the multiple grooves of the first club groove(s). In some embodiments, the first club groove pitch can be similar or identical to the groove pitch described above with respect to club head 100 (FIGS. 1-3).

In some embodiments, one or more of activities 1001-1008 can be performed approximately simultaneously with one or more other ones of activities 1001-1008. In other embodiments, one or more of activities 1001-1008 can be omitted.

Turning now back to FIG. 8, method 800 can comprise activity 802 of providing (e.g., forming) a second golf club head. The second golf club head can be similar or identical to club head 100 (FIG. 1). Accordingly, in many embodiments, performing activity 802 can comprise providing a second club head body of the second golf club head. Further, providing the second club head body can comprise providing a second club face portion of the second club head body. In these or other embodiments, the second club head body can be similar or identical to club head body 107 (FIG. 1); and the second club face portion can be similar or identical to face portion 110 (FIG. 1).

In some embodiments, the second golf club head can comprise a second club loft angle greater than or equal to approximately 45 and less than or equal to approximately 65 degrees. In further embodiments, the second golf club head can comprise a second club loft angle greater than or equal to approximately 45 and less than or equal to approximately 55 degrees. In still further embodiments, the second golf club head can comprise a second club loft angle greater than or equal to approximately 55 and less than or equal to approximately 65 degrees. However, in many embodiments, the second club loft angle can be less than the first club loft angle. For example, the second golf club head can comprise a second club loft angle less than approximately 45 or 55 degrees.

Figure 11:
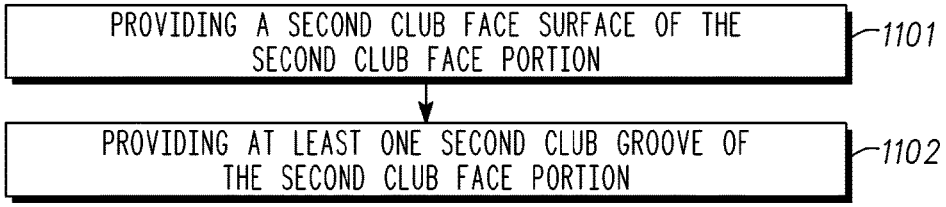
FIG. 11 illustrates an exemplary activity of providing a second club face portion of the second club head body of the first golf club head, according to the embodiment of FIG. 8.

Meanwhile, FIG. 11 illustrates an exemplary activity 1100 of providing a second club face portion of the second club head body of the first golf club head, according to the embodiment of FIG. 8.

For example, activity 1100 can comprise activity 1101 of providing (e.g., forming) a second club face surface of the second club face portion. In many embodiments, the second club face surface can be similar or identical to face surface 114 (FIG. 1).

Figure 12:
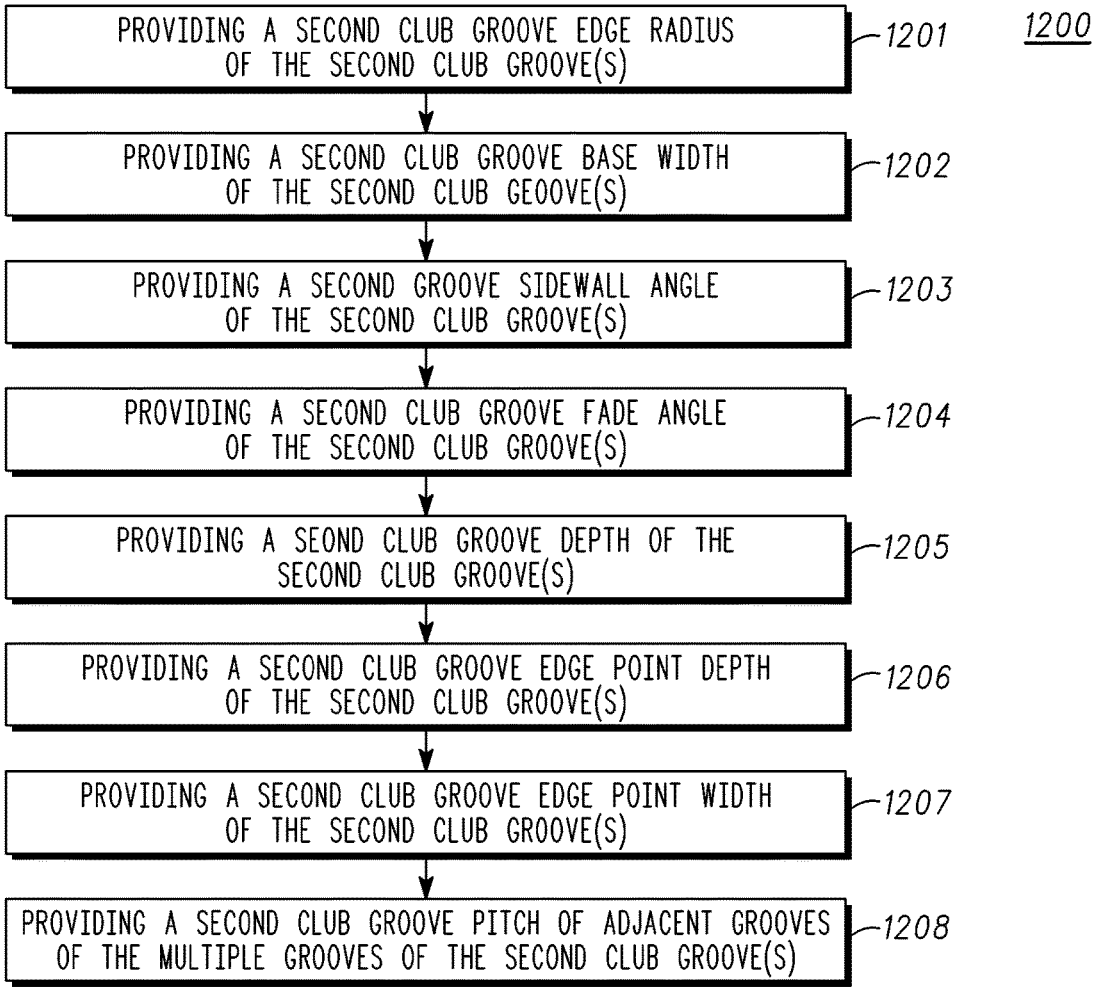
FIG. 12 illustrates an exemplary activity of providing at least one second club groove of the second club face portion, according to the embodiment of FIG. 8.

Further, activity 1100 can comprise activity 1102 of providing (e.g., forming) at least one second club groove of the second club face portion. In many embodiments, the groove(s) can be similar or identical to groove(s) 115 (FIG. 1) and/or groove 127 (FIGS. 1 & 4). In some embodiments, activities 1101 and 1102 and be performed simultaneously with each other such as when the golf club face and at least one first club groove are cast, forged, molded, or otherwise formed when the rest of the golf club head is cast, forged, molded, or otherwise formed. In other embodiments, activities 1101 and 1102 are performed sequentially such that the golf club face is cast, forged, molded, or otherwise formed with other portions of the golf club head, but the grooves are machined, drilled, laser cut, or otherwise formed into the golf club face after the casting, forging, molding, or other forming process. FIG. 12 illustrates an exemplary activity 1102, according to the embodiment of FIG. 8.

For example, in many embodiments, activity 1102 can comprise activity 1201 of providing (e.g., forming) a second club groove edge radius of the second club groove(s). In some embodiments, the second club groove edge radius can be similar or identical to groove edge radius 443 (FIG. 4).

In many embodiments, activity 1102 can comprise activity 1202 of providing (e.g., forming) a second club groove base width of the second club groove(s). In some embodiments, the second club groove base width can be similar or identical to groove base width 444 (FIG. 4).

In many embodiments, activity 1102 can comprise activity 1203 of providing (e.g., forming) a second club groove sidewall angle of the second club groove(s). In some embodiments, the second club groove sidewall angle can be similar or identical to groove sidewall angle 445 (FIG. 4).

In many embodiments, activity 1102 can comprise activity 1204 of providing (e.g., forming) a second club groove fade angle of the second club groove(s). In some embodiments, the second club groove fade angle can be similar or identical to groove fade angle 446 (FIG. 4).

In many embodiments, activity 1102 can comprise activity 1205 of providing (e.g., forming) a second club groove depth of the second club groove(s). In some embodiments, the second club groove depth can be similar or identical to groove depth 447 (FIG. 4).

In many embodiments, activity 1102 can comprise activity 1206 of providing (e.g., forming) a second club groove edge point depth of the second club groove(s). In some embodiments, the second club groove edge point depth can be similar or identical to second groove edge point depth 448 (FIG. 4).

In many embodiments, activity 1102 can comprise activity 1207 of providing (e.g., forming) a second club groove edge point width of the second club groove(s). In some embodiments, the second club groove edge point width can be similar or identical to second groove edge point width 449 (FIG. 4).

In some embodiments, when the second club groove(s) comprise multiple grooves, activity 1102 can comprise activity 1208 of providing (e.g., forming) a second club groove pitch of adjacent grooves of the multiple grooves of the second club groove(s). In some embodiments, the second club groove pitch can be similar or identical to the groove pitch described above with respect to club head 100 (FIGS. 1-3).

In some embodiments, one or more of activities 1201-1208 can be performed approximately simultaneously with one or more other ones of activities 1201-1208. In other embodiments, one or more of activities 1201-1208 can be omitted.

In many embodiments, the first club groove edge radius of the first club groove(s) can be less than the second club groove edge radius of the second club groove(s). Further, the first club groove base width of the first club groove(s) can be less than the second club groove base width of the second club groove(s). Further still, the first club groove sidewall angle of the first club groove(s) can be greater than the second club groove sidewall angle of the second club groove(s). Also, in some embodiments, the first club groove pitch can be less than the second club groove pitch.

Meanwhile, in these or other embodiments, the first groove depth can be the same as the second groove depth; the first groove edge point width can be similar or identical to the second groove edge point width; and/or a ratio of the area of the first club groove(s) to the first club groove pitch can be the same as a ratio of the area of the second club groove(s) to the second club groove pitch.

In many embodiments, one or more of activities 801, 802, 901, 902, 1001-1008, 1101, 1102, and 1201-1208 can be performed using one or more metallurgic techniques including casting, molding, forging, machining, drilling, laser cutting, etc. In these or other embodiments, two or more of activities 801, 802, 901, 902, 1001-1008, 1101, 1102, and 1201-1208 can be performed using the same metallurgic techniques, and/or two or more of activities 801, 802, 901, 902, 1001-1008, 1101, 1102, and 1201-1208 can be performed using different metallurgic techniques.

Although the club head(s) and related methods herein have been described with reference to specific embodiments, various changes may be made without departing from the spirit or scope of the present disclosure. For example, to one of ordinary skill in the art, it will be readily apparent that activities 801 and 802 of FIG. 8, activities 901 and 902 of FIG. 9, activities 1001-1008 (FIG. 10), activities 1101 and 1102 of FIG. 11, and activities 1201-1208 (FIG. 12) may be comprised of many different activities and be performed by many different modules, and in many different orders, that any element of FIGS. 1-8 may be modified, and that the foregoing discussion of certain of these embodiments does not necessarily represent a complete description of all possible embodiments.

Further, while the above examples may be described in connection with an iron-type golf club head, the apparatus, methods, and articles of manufacture described herein may be applicable to other types of golf clubs such as a wood-type golf club or a putter-type golf club. Alternatively, the apparatus, methods, and articles of manufacture described herein may be applicable other type of sports equipment such as a hockey stick, a tennis racket, a fishing pole, a ski pole, etc.

Additional examples of such changes and others have been given in the foregoing description. Other permutations of the different embodiments having one or more of the features of the various figures are likewise contemplated. Accordingly, the specification, claims, and drawings herein are intended to be illustrative of the scope of the disclosure and is not intended to be limiting. It is intended that the scope of this application shall be limited only to the extent required by the appended claims.

The golf club heads and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

Generally, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claim.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A set of golf club heads, the set of golf club heads comprising:

a first golf club head comprising a first club face portion; and a second golf club head comprising a second club face portion;

wherein:

the first club face portion comprises a first club face surface and multiple first club grooves;

each first club groove, respectively, of the multiple first club grooves comprises a first club groove base, a first club groove sidewall adjacent to the first club groove base, a first club groove length dimension, a first club groove central axis approximately perpendicular to the first club groove base, and a first club groove cross sectional area approximately perpendicular to the first club groove length dimension and intersecting the first club groove central axis;

the first club groove central axis of all grooves of the multiple first club grooves are spaced apart by a first club groove pitch;

the first club groove sidewall forms a first club groove sidewall angle;

each first groove of the multiple first club grooves comprises a first club groove edge point and a first club groove edge radius at the first club groove edge point;

the second club face portion comprises a second club face surface and multiple second club grooves;

each second club groove, respectively, of the multiple second club grooves comprises a second club groove base, a second club groove sidewall adjacent to the second club groove base, a second club groove central axis approximately perpendicular to the second club groove base, and a second club groove cross sectional area approximately perpendicular to the second club groove length dimension and intersecting the second club groove central axis;

the second club groove central axis of all grooves of the multiple second club grooves are spaced apart by a second club groove pitch;

the second club groove sidewall forms a second club groove sidewall angle;

each second groove of the multiple second club grooves comprises a second club groove edge point and a second club groove edge radius at the second club groove edge point;

the first club groove edge radius is less than the second club groove edge radius;

the first club groove sidewall angle is greater than the second club groove sidewall angle; and the first club groove pitch is different than the second club groove pitch.

2. The set of golf club heads of claim 1, wherein:

the first golf club head comprises a first club loft angle greater than or equal to approximately 45 degrees; and the second golf club head comprises a second club loft angle less than approximately 45 degrees.

3. The set of golf club heads of claim 1, wherein:

the first golf club head comprises a first club loft angle greater than or equal to approximately 47 degrees; and the second golf club head comprises a second club loft angle less than approximately 47 degrees.

4. The set of golf club heads of claim 1, wherein:

the first club groove edge radius or the second club groove edge radius is greater than or equal to approximately 0.007 centimeter and less than or equal to approximately 0.026 centimeter.

5. The set of golf club heads of claim 1, wherein:

the first groove sidewall angle or the second club groove sidewall angle is greater than or equal to approximately 21 degrees and less than or equal to approximately 27 degrees.

6. The set of golf club heads of claim 1, wherein:

each first club groove of the multiple first club grooves comprises a first club groove depth measured between the first club face surface and the first club groove base;

each second club groove, respectively, of the multiple second club grooves comprises a second club groove depth measured between the second club face surface and the second club groove base; and the first club groove depth is approximately equal to the second club groove depth.

7. The set of golf club heads of claim 6, wherein:

the first club groove depth is approximately 0.04 centimeter.

8. The set of golf club heads of claim 1, wherein:

the first club groove pitch is constant between all grooves of the multiple first grooves.

9. The set of golf club heads of claim 1, wherein:

each first club groove of the multiple first club grooves comprises a first club groove edge point width measured approximately perpendicular to the first club groove central axis and between the first club groove edge point and the first club groove central axis; and the first club groove edge point width is approximately 0.037 centimeters.

10. The set of golf club heads of claim 1, wherein:

the first club groove pitch is greater than or equal to approximately 0.330 centimeter and less than or equal to approximately 0.366 centimeter.

11. A set of golf club heads, the set of golf club heads comprising:

a first golf club head comprising a first club face portion and a first club loft angle; and a second golf club head comprising a second club face portion and a second club loft angle;

wherein:

the first club face portion comprises a first club face surface and multiple first club grooves;

each first club groove, respectively, of the multiple first club grooves comprises a first club groove base, a first club groove sidewall adjacent to the first club groove base, a first club groove length dimension, a first club groove central axis approximately perpendicular to the first club groove base, and a first club groove cross sectional area approximately perpendicular to the first club groove length dimension and intersecting the first club groove central axis;

the first club groove central axis of all grooves of the multiple first club grooves are spaced apart by a first club groove pitch;

the first club groove sidewall forms a first club groove sidewall angle;

each first groove of the multiple first club grooves comprises a first club groove edge point and a first club groove edge radius at the first club groove edge point;

the second club face portion comprises a second club face surface and multiple second club grooves;

each second club groove, respectively, of the multiple second club grooves comprises a second club groove base, a second club groove sidewall adjacent to the second club groove base, a second club groove central axis approximately perpendicular to the second club groove base, and a second club groove cross sectional area approximately perpendicular to the second club groove length dimension and intersecting the second club groove central axis;

the second club groove central axis of all grooves of the multiple second club grooves are spaced apart by a second club groove pitch;

the second club groove sidewall forms a second club groove sidewall angle;

each second club groove of the multiple second club grooves comprises a second club groove edge point and a second club groove edge radius at the second club groove edge point;

the first club loft angle is different than the second club loft angle;

the first club groove edge radius is less than the second club groove edge radius;

the first club groove sidewall angle is greater than the second club groove sidewall angle; and the first club groove pitch is different than the second club groove pitch.

12. The set of golf club heads of claim 11, wherein:

the first club loft angle is greater than or equal to approximately 45 degrees; and the second club loft angle is less than approximately 45 degrees.

13. The set of golf club heads of claim 11, wherein:

the first club loft angle is greater than or equal to approximately 47 degrees; and the second club loft angle is less than approximately 47 degrees.

14. The set of golf club heads of claim 11, wherein:

the first club groove edge radius or the second club groove edge radius is greater than or equal to approximately 0.007 centimeter and less than or equal to approximately 0.026 centimeter.

15. The set of golf club heads of claim 11, wherein:

the first groove sidewall angle or the second club groove sidewall angle is greater than or equal to approximately 21 degrees and less than or equal to approximately 27 degrees.

16. The set of golf club heads of claim 11, wherein:

each first club groove of the multiple first club grooves comprises a first club groove depth measured between the first club face surface and the first club groove base;

each second club groove, respectively, of the multiple second club grooves comprises a second club groove depth measured between the second club face surface and the second club groove base; and the first club groove depth is approximately equal to the second club groove depth.

17. The set of golf club heads of claim 16, wherein:

the first club groove depth is approximately 0.04 centimeter.

18. The set of golf club heads of claim 11, wherein:

the first club groove pitch is constant between all grooves of the multiple first grooves.

19. The set of golf club heads of claim 11, wherein:

each first club groove of the multiple first club grooves comprises a first club groove edge point width measured approximately perpendicular to the first club groove central axis and between the first club groove edge point and the first club groove central axis; and the first club groove edge point width is approximately 0.037 centimeters.

20. The set of golf club heads of claim 11, wherein:

the first club groove pitch is greater than or equal to approximately 0.330 centimeter and less than or equal to approximately 0.366 centimeter.

* * * * *